United States Patent [19]

Lane

[11] Patent Number: 4,558,786

[45] Date of Patent: Dec. 17, 1985

[54] ELECTRO-OPTICAL SORTER

[75] Inventor: Marvin M. Lane, 4714 Eli Ct., Carmichael, Calif. 95608

[73] Assignee: Marvin M. Lane, Carmichael, Calif.

[21] Appl. No.: 504,556

[22] Filed: Jun. 15, 1983

[51] Int. Cl.[4] ..... B07C 5/342

[52] U.S. Cl. ..... 209/558; 209/577; 209/582; 250/226; 356/425

[58] Field of Search ..... 209/576, 577, 580–582, 209/587, 558; 250/226, 553; 356/402, 420, 425

[56] References Cited

U.S. PATENT DOCUMENTS

| | | | |
|---|---|---|---|
| 3,910,701 | 10/1975 | Henderson et al. | 356/73 X |
| 3,939,983 | 2/1976 | Asfour | 209/581 |
| 4,095,696 | 6/1978 | Sherwood | 209/558 |
| 4,146,135 | 3/1979 | Sarkar et al. | 209/580 |
| 4,204,950 | 5/1980 | Burford, Jr. | 209/582 X |
| 4,281,933 | 8/1981 | Houston et al. | 209/582 X |

*Primary Examiner*—Randolph A. Reese
*Assistant Examiner*—Edward M. Wacyra
*Attorney, Agent, or Firm*—Lothrop & West

[57] ABSTRACT

A master clock oscillator produces a series of control pulses to drive a multiple frequency L.E.D. illuminator and an optically coaxial synchronous detection system in an AC based organic/inorganic, ripe/unripe sorter. Data is collected by subjecting free-falling articles to a repetitious sampling cycle and detecting the reflected pulses. Counters running at differential rates, store binary data relating to the size and ripe/unripe condition of the article. At the end of the sampling period, an accept/reject determination is made, based upon the binary data.

6 Claims, 6 Drawing Figures

ELECTRO-OPTICAL SORTER

BACKGROUND OF THE INVENTION

1. Field of the Invention

The invention relates generally to devices for sorting ripe from unripe comestibles, and for sorting comestibles from extraneous, inorganic matter. More specifically, the color sorter herein uses a pulsating, multiple frequency illumination source in conjunction with a synchronous detection system to collect data about the reflectivity responses of the subject objects. The data is subsequently analyzed by comparator and logic circuitry to determine whether a particular object is acceptable or unacceptable. Acceptable objects are passed on for further processing, whereas unacceptable objects are actively removed from the object stream and discarded.

2. Prior Art

It has long been recognized that materials exposed to light wave energy at a selected frequency reflect the incoming light at a characteristic exposure/reflectance amplitude ratio, depending upon the nature or condition of the material. This principle can be used to advantage for sorting purposes where a particular comestible exhibits a light reflectivity response in a ripe and mature condition which differs substantially from the reflectivity response of the same comestible in an unripe and immature condition. Likewise, where an organic comestible does not reflect light in the same fashion as extraneous, inorganic material, such as dirt, a comparison based upon the light reflectance ratios can determine the nature of the material examined.

While a single test frequency can be used, a dual frequency, or biochromatic system provides a far improved signal to noise ratio between the data signals used to make object determinations. The two test frequencies are selected to exhibit a respective amplitude peak or dip in the reflectivity response of the object, depending upon whether the object displays a desirable or an undesirable characteristic.

For example, an immature tomato exhibits a reflectivity peak at approximately 550 nm and a relatively low reflectivity response at 660 nm. On the other hand, a ripe tomato displays a large upswing in reflective respose around 660 nm, and a sharp dip in reflective response at 550 nm. By comparing the reflectivity characteristics of a particular tomato at these two selected frequencies, the comparator circuitry of a tomato sorter will be provided with data having a substantially better signal to noise ratio than if the reflective response were tested at solely one frequency.

It is also evident that more than two test frequencies can be used to good advantage, where the additional frequencies correspond to other characteristics, desirable or undesirable. U.S. Pat. No. 4,120,402, issued to Swanson, shows the use of four test frequencies in a color sorter. Two of the frequencies therein were selected to make a ripe/unripe determination, and two additional frequencies were devoted to detecting and sorting out inorganic, extraneous material.

It is further significant to note that the sorter in Swanson uses a constant amplitude object illuminator, having a broad spectral output. The reflected light can properly be considered an object modulated version of the incident light. The reflected light is then sensed concurrently by four detectors, each fitted with a filter designed primarily to pass light wave energy at one of the four selected frequencies. Consequently, the data output of each detector represents a direct analog of the article's passage through the field of view. In short, the illumination/detection system in Swanson makes object determinations as a substantially constant, or DC frequency.

Sunlight also displays a characteristic broad spectral output, and therefore extraneous sunlight in the field of view leads to unreliable operation of a DC based color sorter. Multiple detectors within a single channel react differently to varying temperatures encountered during in field operations. This is especially true where near and deep infrared test frequencies are used in conjunction with temperature sensitive lead sulfide detector cells. In summary, there are a number of shortcomings inherent in multiple frequency DC based color sorters.

A quite different approach is taken in a color sorter using an AC based, or pulsed light wave illumination/detection system. In an AC based system, the object is sequentially exposed to light wave pulses at a number of discrete frequencies, and a single unfiltered detector senses the reflected light. The output of the detector does not represent a direct analog of the object's presence in the field of view, as in the DC based detector system. Rather, the output of an AC based detector system produces a series of pulses, corresponding to a considerable number of illumination sampling cycles. Averaged over a period of time, the detector output pulses relating to a particular frequency approximate the reflective response of the article under test.

The use of an AC based illumination/detector system permits the use of a single detector per channel, which for reasons to be discussed herein, decreases both the light and temperature susceptibility of the color sorter. Furthermore, the use of pulsed light wave energy also allows the data to be processed and analyzed with much more efficiency and flexibility than with DC based systems. U.S. Pat. No. 4,369,886, jointly invented by Lane, the applicant herein, is representative of an AC based color sorter. The present invention represents an improvement over the known prior art, including that cited above, in its illumination/detector assembly and in its synchronous comparator/logic circuitry.

SUMMARY OF THE INVENTION

The present invention employs a master clock oscillator, controlling both the transmit and the receive systems in a pulsating, or AC derived, electro-optical sorter. The transmit, or illumination system includes a plurality of light emitting diodes assembled along an illuminator/detector bar. Each L.E.D. transmits light wave energy at one of four discrete test frequencies. Two of the test frequencies are used to make an inorganic/organic determination, and the remaining two frequencies are used to make a ripe/unripe determination. The control pulses produced by the master clock are routed sequentially to activate L.E.D.s of common frequency output in a rapid, repetitive fashion, so that hundreds of four pulsed exposure cycles are completed per second.

As objects are passed into the exposure zone, the light wave pulses are reflected back and intercepted by a plurality of unfiltered detectors, positioned substantially on the optical axis of the illuminating diodes. Each detector is oriented toward a segment of the exposure zone, and will only detect reflected pulses from objects passing through that particular zone segment. The detectors produce electrical pulses corresponding in amplitude and occurence to the sequentially ordered, reflected pulses.

Synchronization circuitry, also responsive to the control pulses, directs the detectors' output to individual capacitors for storage of the instantaneous value of the reflective response of the object at a respective one of the test frequencies. Three comparators are then employed to make logic determinations based upon the voltage stored in the capacitors. A threshold comparator determines whether an object is present within the field of view which warrants consideration. If the object's response at a first infrared frequency exceeds a predetermined threshold voltage, the threshold comparator's output activates an object size counter, which runs at an established clock frequency as long as the object is within the field of view.

An organic/inorganic comparator evaluates the object's reflective responses at the first and a second infrared frequency to determine whether the object is inorganic and extraneous, or organic and at least preliminarily desirable. A color comparator considers the object's reflective responses at two visible light frequencies corresponding to the colors of the desirable ripe comestible and of the undesirable unripe comestible.

The outputs of the second and third comparators and AND logic interfaced, so that if two predetermined conditions are satisfied, namely, that the object is both organic and ripe, a logic YES signal is passed on to an object color counter. When actuated, the color counter runs at an established frequency twice that of the size counter. Accordingly, as long as a ripe, organic object is within the detector's field of view, the color counter will continue counting, and eventually fill up at a rate twice that of the size counter.

The binary outputs of the size and color counters are fed into a 4-bit magnitude comparator. If either the object exceeds a predetermined size or the object leaves the field of view, the magnitude comparator will compare the binary number outputs of the size and color counters. If the binary number output of the size counter is greater than that of the color counter, a reject signal will be passed along to a reject mechanism to remove the article from the object stream. However, if the 4-bit number output of the color counter is equal to or greater than that of the size counter, no reject signal will be produced, and the object will be passed on for further processing. In effect, the differential clocking rate between the size and color counters ensures that objects exhibiting at least a 50% ripe condition over their exposed surfaces will be deemed acceptable by the sorter.

It is an object then, of the present invention to provide a multi-frequency, AC based color sorter using a substantially coaxial illumination/detector system.

It is a further object to provide a multi-frequency, AC based color sorter capable of making both organic/inorganic and ripe/unripe determinations, using a light emitting diode transmitter bar in combination with a plurality of single detector receivers.

It is a further object to provide a master clock oscillator in a multi-frequency, AC based color sorter for controlling and synchronizing the L.E.D. illuminators and the detectors' comparator/logic circuitry.

It is a further object to provide a multi-frequency, AC based color sorter capable of color qualitative sorting, providing the object exhibits a desirable characteristic over a predetermined percentage of its sampled surface.

These and other objects will become further apparent in the drawings and the detailed description of the preferred embodiment to follow.

DETAILED DESCRIPTION OF THE PREFERRED EMBODIMENT

Figure 2:
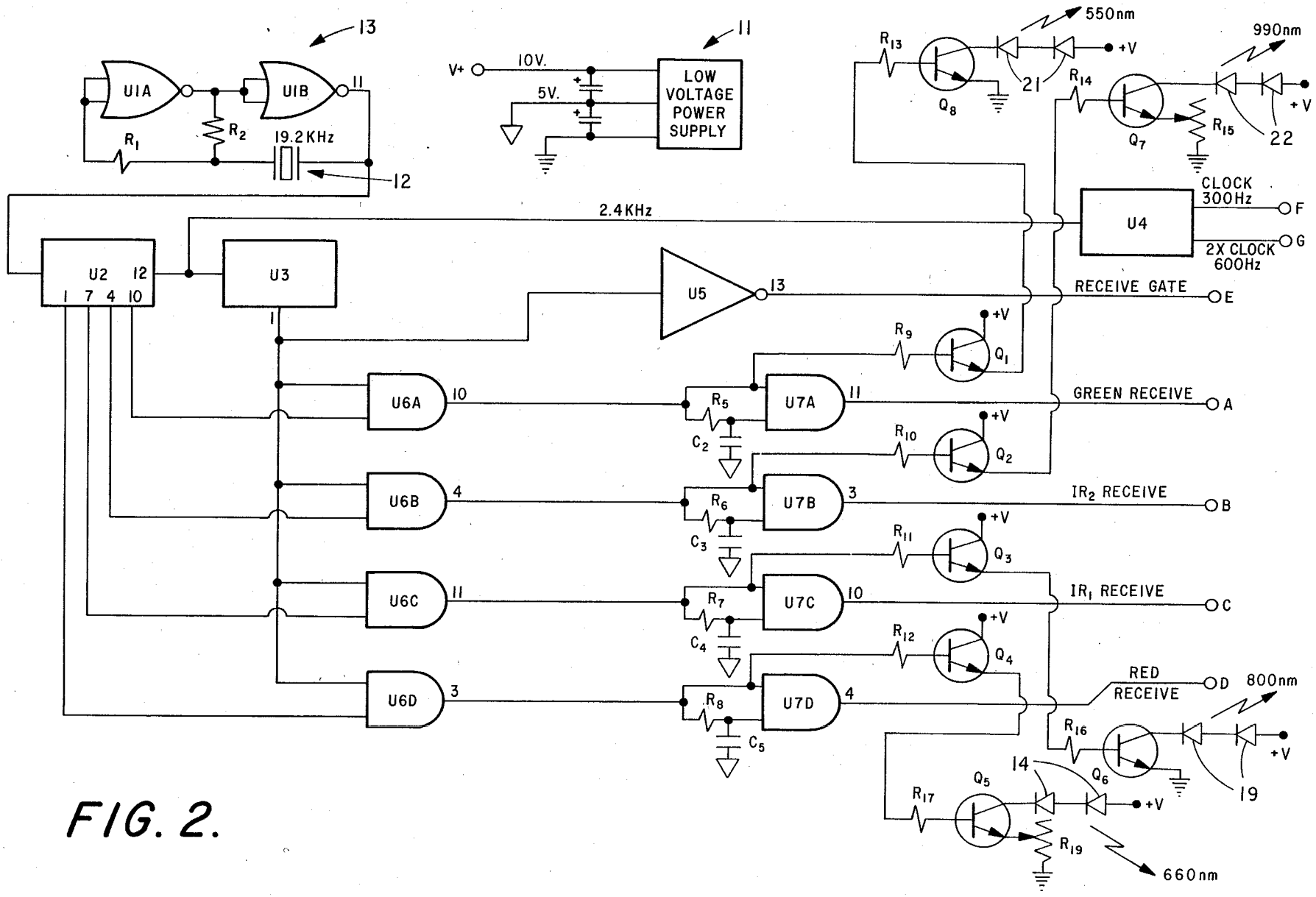
FIG. 2 is a partial schematic of the invention, showing the control pulse and light illumination circuitry.
Figure 3:
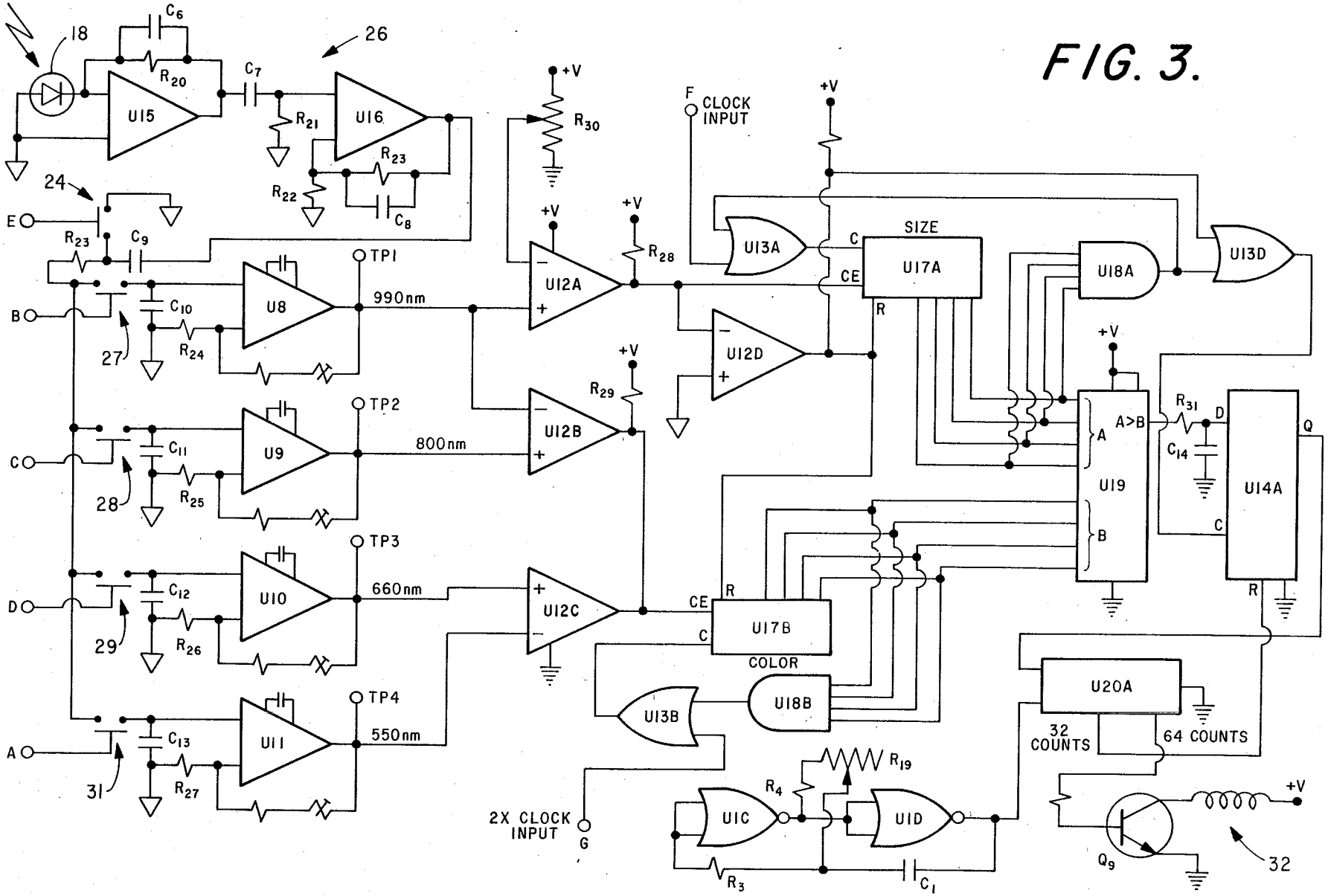
FIG. 3 is the remainder of the schematic, showing the detector, synchronous demodulator, logic, and object rejection circuitry.

Making specific reference to FIGS. 2 and 3, it is noted initially that the two figures sould be considered together, forming the complete schematic for the sorter. It is also apparent that the terminals A–G, inclusively, shown on FIGS. 2 and 3, are assumed to be interconnected between the two partial schematics. Also, it should be noted that a low voltage power supply 11, having a 10 Volt output at terminal V+ and a 5 Volt output at terminal ∇, is interconnected to like terminals shown both in FIG. 2 and in FIG. 3.

Figure 5:
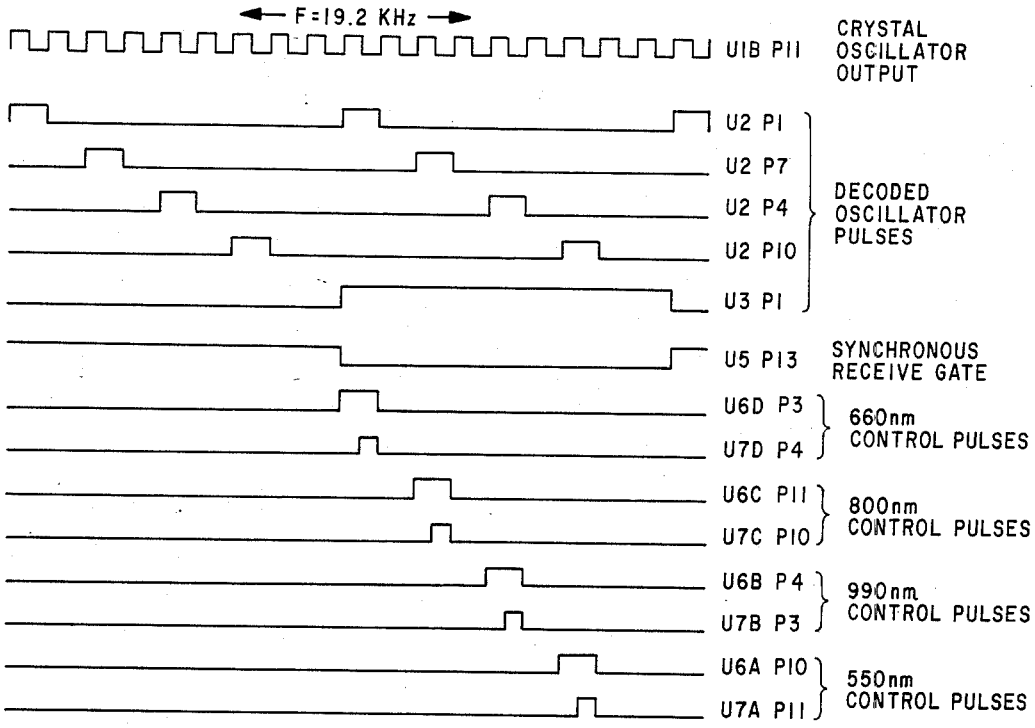
FIG. 5 is a timing diagram, showing the relationships of various pulses derived from the master clock oscillator; and, FIG. 6 is a graph depicting the reflective light response of dirt, a green tomato, and a red tomato over a selected frequency range.

In FIG. 2, NOR Gates U1A and U1B in combination with $R_1$, $R_2$, and the 19.2 KHz crystal 12, form the master clock oscillator 13. FIG. 5 shows the oscillator's 19.2 KHz square wave output before it undergoes decoding and further processing. This output, available at U1B pin 11, is passed to U2, an octal or one of eight counter having eight decoded outputs, normally low and going high only during their appropriate octal time period. Four of the eight decoded outputs are directed to respective input legs of AND Gates U6A–U6D, inclusively.

At pin 12 of U2, a carryout frequency of 2.4 KHz is provided to clock a second octal, or one of eight counter U3, and a seven stage ripple counter U4. The outputs of the ripple counter U4 are clock frequencies of 300 HZ and 600 HZ, interconnected to terminals F and G, respectively. The function of these clock frequencies will be discussed more fully, herein.

The output at pin 1 of the counter U3 is fed into a bus line, interconnected to the remaining input legs of Quad AND Gate U6. The cascaded operation of U2 and U3 is such that during a selected sixty-four clocking period of the oscillator 13, the output of U3 first goes high for eight clocks and then goes low again for 56 clocks. Making reference now to FIG. 5, it is evident that the decoded oscillator pulses, each having a duration of one clock and separated from each other by one clock, conjoin with the output of U3 in the AND Gates of U6 to produce a series of sequential control pulses.

The first control pulse is routed from U6D pin 3, through R12 to the base of follower mode transistor Q4. The control pulse is therein amplified and fed through R17 to L.E.D. drive transistor Q5. Activated by the 52u second control pulse, transistor Q5 allows current to flow through the red L.E.D.s 14, producing a light wave pulse at a frequency of 660 nm, or 0.66 microns. Similarly, the second, third, and fourth control pulses produced by U6C, U6B, and U6A, respectively, actuate their respective follower mode and L.E.D. drive transistors, as indicated in FIG. 2.

With the L.E.D. drive circuitry interconnected as shown, the sequence of illumination pulses is red (660 nm), IR1, (800 nm), IR2 (990 nm), and green (550 nm). It has been determined that the amplitude of the green 550 nm pulse must be considerably greater than that of the remaining pulses to ensure adequate reflective light levels. Consequently, it has proven desirable to place the high current, 550 nm pulse at the end of the four pulse sampling, or illumination cycle to lessen the chance that extraneous transients it may produce will not adversely affect the stored data. However, the particular order of the test pulses is not otherwise of concern, and can readily be reordered to suit the application.

The control pulses also act to regulate receiver demodulator circuitry, synchronizing the occurance of a particular illumination pulse with the storage of an electrical signal corresponding to its detected, reflected pulse. Accordingly, the first control pulse is also fed into section U7D of Quad AND Gate U7. The RC combination of R8 and C5 delays the response time of U7D to the incoming control pulse. Therefore, the 52u second control pulse is shortened to approximately 26u seconds at the output pin 4 of U7D (compare 660 nm control pulses, FIG. 5). By delaying the onset of the receive control pulse at terminal D, the detector circuitry will have a sufficient amount of time to stabilize in response to the reflected pulse before the electrical signal value is stored.

In like fashion, each control pulse for the other three frequencies is correspondingly delayed, providing receive control pulses for IR1, IR2, and the green pulses at terminals C, B, and A, respectively, (see FIG. 2).

The input of inverter U5 is also driven by the output of U3 at pin 1. The inverted output of U5 provides a receive gate, synchronous with the illumination, or sampling cycle. As illustrated in FIG. 2, the receive gate is interconnected to circuitry in FIG. 3 by means of terminal E.

Figure 4:
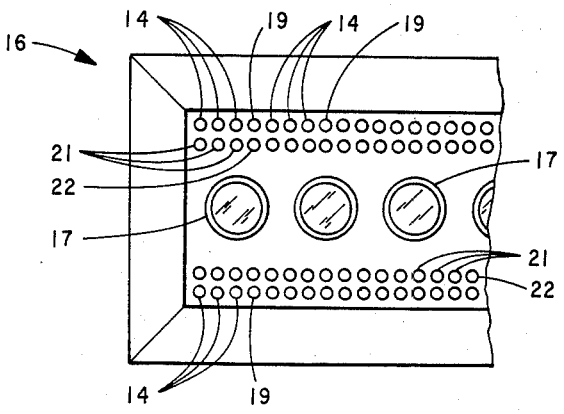
FIG. 4 is a front elevational view of the illuminator/detector assembly, showing the line of detector lenses straddled by rows of light emitting diodes.

Directing attention now to FIG. 4, the illuminator/detector assembly 16 includes a line of detector lenses 17 for collecting reflected light and concentrating same upon rearwardly positioned detectors 18. For the application described herein, namely, sorting tomatoes, these detectors 18 are preferably of the silicon cell variety, having adquate optical sensitivity in the frequency spectrum of interest (approximately 500 to 1000 nm). However, it may also be of interest to employ test frequencies in the deep infrared range, down to 2000 nm, or so, depending upon the material determination to be made. If this were the case, lead sulfide cells, highly sensitive to deep infrared energy, would perform well as substitutes for the silicon detectors used herein. Unfortunately, lead sulfide cells are also very sensitive to temperature variations, and are further variable in the manner and extent of temperature dependency from unit to unit. Consequently, sorters which use multiple lead sulfide detectors per channel are difficult, if not impossible, to maintain in calibration over a wide temperature range. However, the single detector per channel design of the present invention makes calibration of each channel a relatively quick procedure which can be performed in the field, if necessary.

In addition to changes in the detection system, L.E.D.s operating in the deep infrared region would have to replace the higher frequency L.E.D.s used herein. Although L.E.D.s operating in the deep infrared region are not readily available at the moment, when they are, the present invention could easily be adapted to sorting applications in the deep infrared region by substituting the appropriate L.E.D.s and associated drive components, as necessary.

Rows of light emitting diodes straddle the line of detector lenses 17. As viewed in FIG. 4, red L.E.D.s 14 extend across the uppermost and lowermost rows in groups of three. Between each group of three red L.E.D.s is an IR 1 L.E.D. 19, producing pulses at approximately 800 nm. The two innermost rows of light emitting diodes include groups of three green L.E.D.s, spaced by an IR2 L.E.D. 22, producing pulses at 990 nm. This arrangement of L.E.D.s extends across the entire assembly 16, in effect, creating a distributive illumination source. While only a representative number of drive transistors and respective L.E.D.s is shown in FIG. 2, a practical sorter, having an illuminator/detector assembly 16 three to four feet wide, will have many more such devices than shown herein. In such a system, all like kind L.E.D.s are interconnected in series/parallel fashion to match voltage and current requirements, and therefore are also driven simultaneously. In other words, all red L.E.D.s 14 are illuminated across the assembly 16 in response to the 660 nm control pulse. The 800 nm, 990 nm, and 550 nm L.E.D.s are likewise commonly driven in response to their respective control pulses.

By distributing the creation of each illumination pulse among a plurality of L.E.D.s, certain problems associated with the extraneous "white flash", or specular reflection phenomenon are alleviated. Characteristically, an object having a smooth, shiny surface, such as a tomato, exhibits specular reflection when exposed to light and viewed at a particular angle to the object's surface. This specular reflection does not truly represent the color of the object, and can therefore produce false readings when detected by a color sorting apparatus. Additionally, the problem is more pronounced where the illuminating source comes from a single point, as opposed to a plurality of sources. Accordingly, the use of multiple L.E.D.s to illuminate the objects sorted herein assures that the reflective response of an object will more accurately correspond to its true color.

Further, the placement of the detector lenses 17 with respect to the illuminating light emitting diodes provides improved reflectance sampling of the articles to be sorted. In contrast to known prior art sorters, the adjacent and substantially coaxial orientation of the illuminators and the detector's lenses ensures maximum reflectance levels for given incident light levels. In short, the substantially coaxial relationship between the L.E.D.s and the lenses 17 improves the accuracy of the collected data, thereby enhancing the overall reliability of the sorter.

The illuminator/detector assembly 16 is positioned off the end of the supply conveyor 23, so as to expose the subject articles in free fall. By sampling the articles during free fall, false readings caused by dirt adhered to the surface of the conveyor belt 23 are avoided. The free falling articles are exposed to the sequence of light wave pulses, and each detector lens intercepts the reflected light pulses from articles solely within its respective field of view.

Each receive channel includes its own detection and logic circuitry, and the circuitry for one such receive channel is shown in FIG. 3. While each receive channel makes reject/accept determinations based upon data collected independently, the general operation of all receive channels is coordinated by sharing receive control pulses, counter clocking pulses, and a synchronous receive gate.

Prior to the onset of each four pulsed sampling cycle, the output of the inverter U5 is high, causing analog switch 24 to conduct. This interconnection provides a conductive path to ground for current passing from the two stage preamplifier 26 through input capacitor C9. The charge thereby placed upon C9 corresponds solely to the resting gain of the preamplifier 26 and any residual ambient light sensed by the detector 18 which passes through the preamplifier.

Turning now to FIG. 3, the sequential reflected pulses within the field of view of a particular lens 17 are collected and focused upon a respective silicon cell detector 18. The current output is amplified and converted into a voltage by U15. C7 and R21 comprise a decoupling network, designed substantially to filter out the DC component of the detected light. Accordingly, extraneous ambient light, which is not varying in amplitude at a rate commensurate with the illuminating L.E.D.s, is greatly reduced in amplitude by this decoupling network. U16 further amplifies the AC component of the signal to a level of approximately one volt.

The output of the two stage preamplifier 24 is then passed on to synchronous demodulator circuitry, where reflective signal values for the four test frequencies are processed and routed to respective capacitors for storage. Making reference to FIG. 5, when the output of U3 at pin 1 goes high to pass the control pulses, a synchronous receive gate is produced at the output of U5 at pin 13. The low receive gate opens analog switch 24 for the duration of the sampling cycle, and allows the received signals to be processed and stored.

With the analog switch 24 open, the charge stored in input capacitor C9, corresponding to ambient light and preamplifier resting gain, opposes the incoming composite signal value for the first pulse, transmitted at a test frequency of 660 nm. The composite signal includes the ambient light, the preamplifier resting gain, and the detected signal corresponding to the amplitude of the reflected pulse. Consequently, the capacitor C9 substracts out the ambient light and resting gain values, leaving only the resultant detected signal to be passed along for storage.

The receive control pulse passed from U7D pin 4 through terminal D causes analog switch 29 to conduct, applying the 660 nm resultant signal value upon capacitor C12 (see FIG. 3). Once the receive control pulse ceases, analog switch 29 reopens, isolating capacitor C12 from the next incoming pulse signal. Sequentially, and in response to respective control pulses, analog switches 28, 27 and 31 are actuated to impress resultant signal values for 800 nm, 990 nm, and 550 nm, respectively, upon capacitors C11, C10, and C13. The resultant signal values are amplified by the variable gain followers U8–U11, inclusively. During initial calibration of the sorter, test points TP1, TP2, TP3, and TP4 are monitored while placing a reference card within the field of view of a particular channel, and the followers are then adjusted for appropriate balance among the output signal levels.

The output of U8, corresponding to the reflected IR2, or 990 nm pulse, is interconnected to the (+) input of a threshold comparator, U12A. An adjustable threshold voltage is applied by way of potentiometer R30 to the (−) input of U12A. When the voltage present at the (+) input exceeds that at the (−) input, the normally low output of U12A goes high. The threshold voltage is adjusted so that the output of U12A will remain low unless the object is large enough to warrant consideration. In this manner, the sorter is desensitized so that it will not respond to minute articles passing through the field of view.

Comparator U12D has a normally high output, holding size counter U17A and color counter U17B in a cleared, reset status. However, once an article of threshold size has been detected, the output of U12D goes low, preparing U17A and U17B to count the incoming data.

Turning first to the operation of the size counter U17A, U4 provides continuous clock pulses at a frequency of 300 Hz through terminal F to one input of OR Gate U13A. With U12A driving the clock enable of U17A high, and U13A passing the 300 Hz clock pulses on to the clock input ot U17A, the size counter will continue to clock until one of two events occurs.

In the first instance, a sufficiently large article will cause U17A to fill, approximately 50 milliseconds from the initial detection. Since articles pass through the field of view of the detector 18 at a rate of approximately 1 inch every 20 milliseconds, an article 2½ inches in size, or larger, will completely fill and lock up the size counter U17A. As shown in FIG. 3, the output of U17A is fed both to a 4-bit magnitude comparator U19 and to a 4 input AND Gate U18A. With U17A full, the outputs of U18A and U13A go high, in effect, locking up the size counter registering its maximum binary number output. Counter U17A will remain in this filled and locked up condition until the object is no longer detected, causing U12A to go low. U12D, in turn, will go high, resetting both U17A and U17B.

However, in the event that the article or object does no exceed 2½ inches in size, the output of U12A will go low before U17A has had a chance to fill up completely. Consequently, at the moment the article leaves the detector's field of view, the output of U17A will register a binary number commensurate with the article's size. As before, when U12D returns to a high output state, U17A and U17B are reset to zero.

Figure 6:
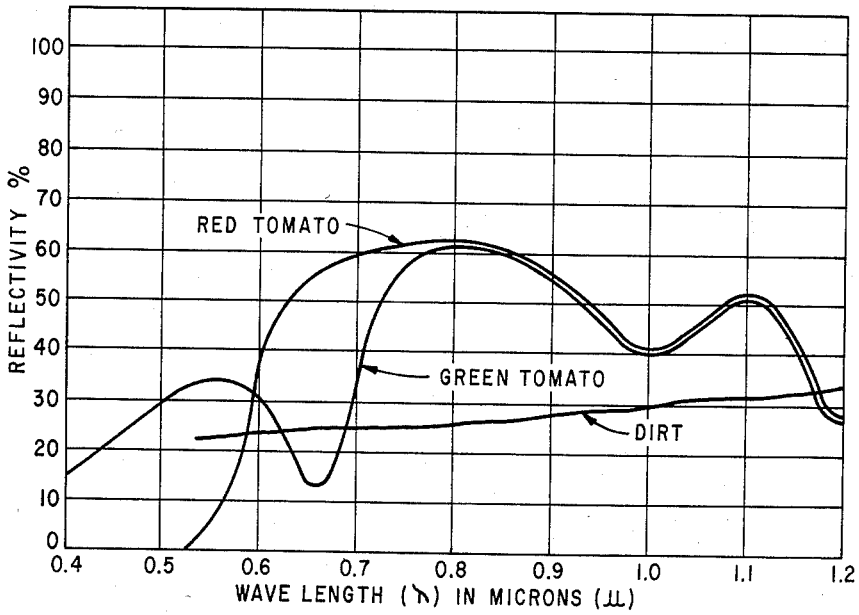

Attention will now be directed to the color counter U17B and its associated circuitry. Initially it is noted that the color counter U17B is not enabled unless two conditions are satisfied, namely, that the article is both vegetable (organic) and is ripe (red). To that end, organic/inorganic comparator U12B compares the article's reflective responses at IR2 (990 nm) and at IR1 (800 nm). Making reference to FIG. 6, it is apparent that the response of dirt, the most common inorganic, extraneous material, is higher at 990 nm than at 800 nm. Owing to the tomato's characteristic "water dip" response, the reflective response of both red and green tomatoes at 800 nm is considerably higher than their response at 990 nm. Consequently, a differential reflectance ratio exists at these two frequencies for tomatoes and inorganic materials to be sorted.

If the article is inorganic or extraneous material, comparator U12B will maintain its normally low output, and the color counter U17B will remain disabled. However, if the article is vegetable or organic, the output of U12B will go high, providing the output of color comparator U12C is concurrently high. In other words, the joined outputs of U12B and U12C are AND-logic interconnected, so that both comparators must go high concurrently for an enable signal to pass to U17B.

Color comparator U12C compares the article's reflective response to visible red pulses (660 nm) with that of visible green pulses (550 nm). Again referring to FIG. 6, a ripe red tomato shows a broad reflectance peak around 660 nm and an extremely low response at 550 nm. Conversely, an unripe green tomato shows a significant reflectance peak at 550 nm and a pronounced reflectance dip about 660 nm. Accordingly, reflectance measurements made at these two test frequencies will provide good data for the comparator U12C to make a ripe/unripe determination.

If a green, unripe tomato is detected, U12C will hold the interconnected outputs of U12B and U12C low, and U17B will not count. In the event that a red, ripe tomato is sensed, both conditions will be satisfied (i.e. red and not dirt), and a high signal will pass to the clock enable input of U17B.

U4 produces continuous 2× clock pulses at a frequency of 600 Hz through terminal G to one input of OR Gate U13B. With comparators U12B and U12C driving the clock enable of U17B high, and U13B passing the 600 Hz clock pulse on to the clock input of U17B, the color counter will continue to clock until one of three events occurs.

In the first instance, if a ripe vegetable is constantly detected for a period of at least 25 milliseconds, the color counter will fill and lock up. The output of U17B is fed both to a 4-input AND Gate U18B and to the 4-bit magnitude comparator U19. When U17B fills, the outputs of U18B and U13B go high, and lock up the color counter registering its maximum binary number output. It is also possible that the tomato or vegetable will alternatingly display both ripe and unripe characteristics while it passes through the detector's field of view. As long as the article displays ripe characteristics for a total of 25 milliseconds during the entire sampling period, the counter U17B will still fill and lock up.

Counter U17B will remain in this filled and locked up condition until the object sampling period is completed i.e. either when the object leaves the detector's field of view or when the object is determined to exceed 2½ inches in size, whichever event occurs first.

Lastly, if a total of 25 milliseconds of a ripe condition is not detected during the entire testing period, the color counter U17B will register a binary number which relates to the percentage or proportion of the object's exposed surface displaying a ripe condition. This intermediate binary number will be assessed at the moment the sampling period is completed, in the manner previously set forth.

During the sampling period, the data outputs of both U17A and U17B are fed to respective inputs of the 4-bit magnitude comparator U19. The binary number A corresponds to the size of the object and the binary number B relates to the object's material characteristics and condition—i.e. in this instance, the extent to which the object is both organic and ripe. The magnitude comparator U19 constantly compares number A with number B, and if A is greater than B, a high output signal will be present at U19's A>B output. In the event that number B is equal to or greater than number A, no output will be present at the A>B output terminal. Over the course of the sampling period, the relationship between numbers A and B may shift back and forth, as different parts of the article are tested. However, the sorter only makes a reject or accept determination at the end of the sampling period, so the interim relationship between numbers A and B has no direct bearing upon the final determination.

The sampling period begins, of course, when the object first enters the field of view, and ends either when the object leaves the field of view or when the size counter U17A fills up. As discussed earlier, a high reset signal is produced by U12D when an article is no longer detected. This reset signal is also routed to one input of sample trigger OR Gate U13D. The other input of U13D is interconnected to the output of U18A. Consequently, a sample trigger signal is sent to sample gate U14A, a data type flip-flop, at the trailing edge of the 990 nm signal for an object smaller than 2½ inches, or after 2½ inches have been sampled of an object larger than 2½ inches.

Since the reset or clear signal to the counters U17A and U17B is substantially concurrent with the production of the sample trigger signal, the RC network R31 and C14 is provided at the input of U14A briefly to store whatever output may be present at the A>B terminal of U19 at the moment of sampling. In other words, if U19 has determined that number A is greater than number B at the moment of sampling, the reject signal will be preserved by the RC network so that it can be passed through U14A.

If number A is greater than number B at the end of the sampling period, the object is either inorganic, extraneous material or it may be organic, vegetable matter which displays unripe characteristics over 50% of its sampled surface. Since color counter U17B is running at twice the rate of the size counter U17A, a tomato displaying ripe characteristics over only 50% of its sampled surface will be deemed acceptable by the sorter. By varying the relative clock rates of the size and color counters, different reject/accept ratios are readily programmed. However the one to two ratio between clock drive rates for U17A and U17B, disclosed herein, has proved a satisfactory compromise between saving partially green or unripe tomatoes which would otherwise be lost in a conventional sorter and ensuring an adequately high standard for ripe tomatoes to be passed on for processing.

At the end of the sampling cycle, U13D will trigger the sampling gate U14A, clocking through the data present at that time of U14A's D input. If the object was determined acceptable by U19, then the D input will be low, and no reject signal will be passed through.

In the event that the object is acceptable, the D input will be high and a reject signal will pass from the Q output to a 64 bit, delay shift register U20A. NOR Gates U1C and U1D form a variable frequency delay oscillator, determining the rate at which U20A shifts the reject pulse through. To transform the indeterminate reject signal into a pulse of predetermined length, an output is taken from U20A at 32 counts and fed into the reset input of the flip-flop. This resets the flip-flop and causes the Q output to go low. In effect, this limits the duration of the reject pulse traveling through the shift register to approximately 20 millisecond seconds, providing R19 is properly adjusted.

Figure 1:
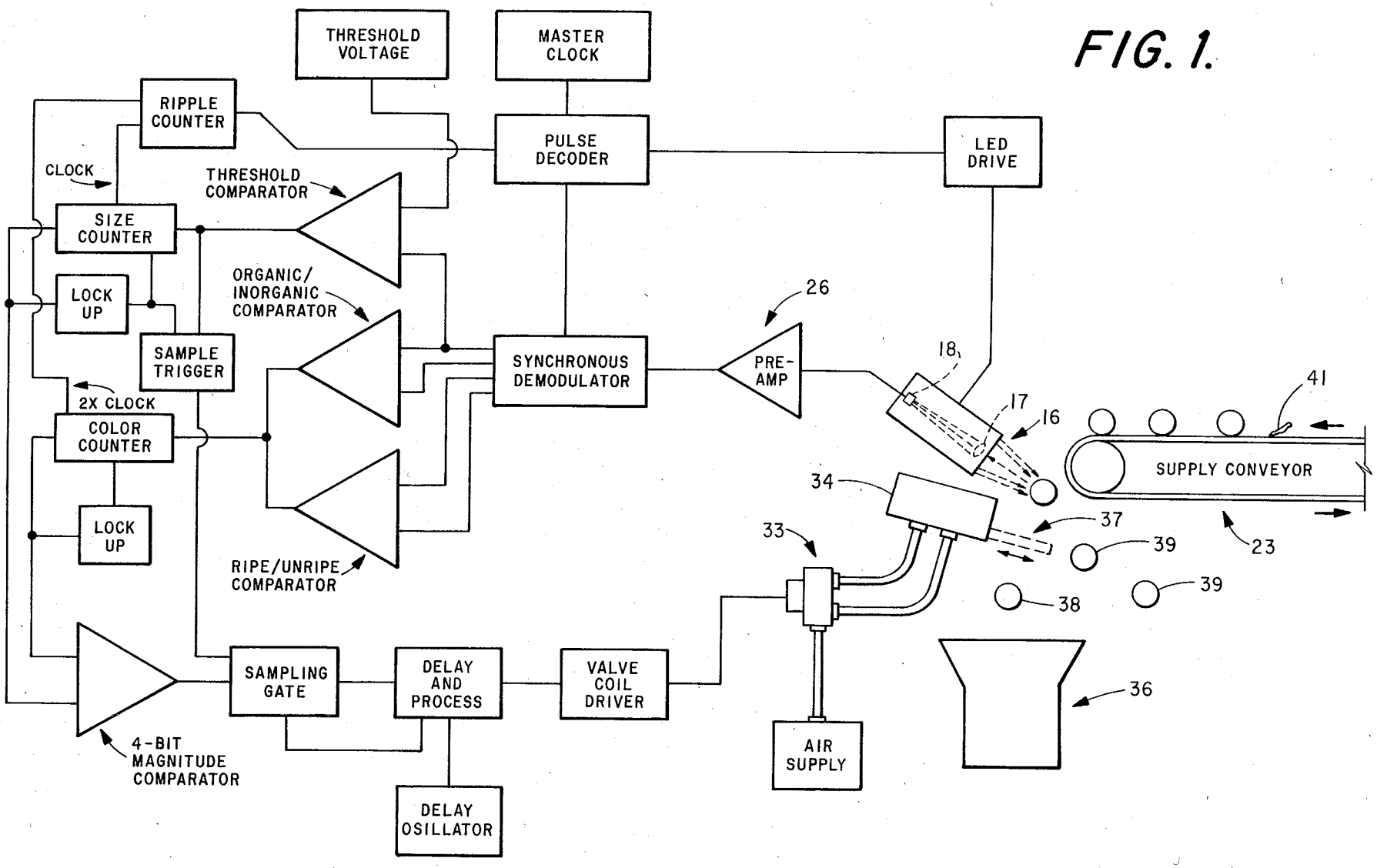
FIG. 1 is a functional block diagram of the invention.

The output of the shift register U20A at 64 counts is fed to Q9, the drive transistor for the pneumatic valve coil 32. Making reference to FIG. 1, an air supply is provided to the pneumatic valve 33, so that when the reject pulse actuates the coil 32, a pulse of pressurized air is passed to the reject mechanism 34. Unripe tomatoes 39 and inorganic extraneous materials 41 are actively removed from the object stream by a pneumatically actuated reject rod 37. Ripe tomatoes 38 do not cause a reject signal to be produced, and are allowed to continue free falling into the collector bin 36 for further processing.

While the present invention has been described specifically in an application for sorting tomatoes, it is equally capable of sorting other comestibles, in accordance with their particular ripe/unripe color characteristics. The frequencies of the light emitting diodes may require appropriate changes, but the basic operation of the sorter will remain substantially the same.

It is also evident that while the present sampling cycle includes four illumination pulses, it could readily be expanded to include more pulses at different frequencies, should additional tests of the objects' characteristics be desirable. In addition, it would be possible to include an additional bank or assembly of L.E.D.s and detectors, opposite the illuminator/detector assembly 16 shown in FIG. 1. This additional assembly could provide further information about the opposite side of the object as it drops between the assemblies, and this data could similarly be counted and compared within a magnitude comparator such as U19. The control pulses for the additional illuminator/detector assembly would be derived from the same master clock oscillator, but the pulses would have to alternate or be offset in time from those of the first assembly so that optical interference would not occur.

It will be appreciated, then, that I have provided an electro-optical sorter for making material and ripe/unripe determinations with greatly improved accuracy and flexibility.

I claim:

1. An apparatus for sorting inorganic and unripe organic articles from ripe organic articles, comprising:

a. master clock means for producing sequential control pulses;

b. illumination means responsive to said control pulses, for exposing the articles to a sampling cycle, said sampling cycle including sequential pulses of light at four discrete frequencies, said frequencies corresponding to the maximum light reflectivity responses characteristic of the inorganic, organic, ripe, and unripe articles;

c. detector means directed at the articles for producing sequential electrical signals commensurate in amplitude to the intensity of light pulses reflected from the materials;

d. comparator means for producing enabling output signals if said electrical signals bear a predetermined relationship, said comparator means including: a color comparator adapted to produce an output signal when the electrical signal corresponding to a ripe article exceeds the electrical signal corresponding to an unripe article; an inorganic/organic comparator adapted to produce an output signal when the electrical signal corresponding to an organic article exceeds the electrical signal corresponding to an inorganic article; a threshold comparator responsive to a selectively variable threshold voltage and adapted to produce an output signal when said electrical signal corresponding to an inorganic article exceeds said threshold voltage;

e. synchronization means responsive to said control pulses, for directing the electrical signals from said detector means to respective inputs of said comparator means in synchronization with the production of each of said sequential pulses;

f. logic means responsive to said enabling output signals of said comparator means for producing a reject signal if the article is not both organic and ripe over a predetermined percentage of its sampled surface, said logic means including a size counter enabled by the output of said threshold comparator, and a color counter enabled by the joined outputs of said organic/inorganic comparator and said color comparator, said color counter being clocked at a rate exceeding the clock rate of said size counter so that the ratio between the clock rates will reflect the predetermined percentage, said logic means further including a magnitude comparator adapted to produce a reject signal if the numerical output of said size counter exceeds the numerical output of said color counter; and, g. means for physically separating inorganic and unripe organic articles from the ripe organic articles in response to the reject signal.

2. An apparatus as in claim 1 including lock up means, responsive to the numerical outputs of said size counter and said color counter effective to prevent either of said counters from counting past its maximum numerical output, once reached.

3. An apparatus as in claim 2 including sample trigger means responsive both to the output of said threshold comparator and to an output of said lock up means, and in which an output of said sample trigger means is interconnected to a sampling gate, said sampling gate being interposed between the output of said magnitude comparator and said article separation means, whereby a trigger signal will be produced in the event an article is no longer detected or in the event said size counter fills up to its maximum numerical output, said trigger signal being effective to actuate said sampling gate and pass the output of said magnitude comparator to said article separation means.

4. An apparatus as in claim 3 including a plurality of sampling cycles over the duration of a sampling period, the sampling period being initiated when the article enters a field of view of the detection means and terminating upon the occurance of the sample trigger signal.

5. An apparatus as in claim 4 including conveyor means for passing articles through the field of view of the detector means.

6. An apparatus for sorting inorganic and unripe organic articles from ripe organic articles, comprising:

a. master lock means for producing sequential control pulses;

b. a first illumination/detector assembly including: first illumination means responsive to a first set of said control pulses for exposing one side of the articles to a first sampling cycle, said first sampling cycle including sequential pulses of light at four discrete frequencies, said frequencies corresponding to the maximum light reflectivity responses characteristic of the inorganic, organic, ripe, and unripe articles; and, first detector means directed at said one side of the articles for producing a first set of sequential electrical signals commensurate in amplitude to the intensity of light pulses reflected from said one side of the articles;

c. a second illumination/detector assembly, identical to and directed toward said first illumination/detector assembly, and including a space between said assemblies for passing and exposing the articles, said second illumination/detector assembly being responsive to a second set of said control pulses offset in time from those of said first set of control pulses, so that optical interference will not occur between said first sampling cycle and the second sampling cycle;

d. comparator means for producing a first set of enabling output signals if said first set of electrical signals, corresponding to the reflectivity responses from one side of the articles, bears a predetermined relationship, and further for producing a second set of enabling output signals if a second set of electrical signals, corresponding to the reflectivity responses from the opposite side of the articles, bears said predetermined relationship;

e. synchronization means responsive to said first and second sets of control pulses, for directing said first and second set of electrical signals to respective inputs of said comparator means in synchronization with the production of each of said sequential pulses;

f. logic means responsive to said output signals of said comparator means for producing a reject signal if the article is not both organic and ripe over a predetermined percentage of its sampled surface, said logic means including a size counter and a color counter clocked at differential rates so that the ratio between the clock rates will reflect the predetermined percentage, said logic means further including a magnitude comparator adapted to produce a reject signal if the numerical output of said size counter exceeds the numerical output of said color counter; and, g. means for physically separating inorganic and unripe organic articles from the ripe organic articles in response to the reject signal.

* * * * *